US010745175B2

(12) United States Patent
Harms et al.

(10) Patent No.: US 10,745,175 B2
(45) Date of Patent: Aug. 18, 2020

(54) CONTAINER WITH A TAPER MECHANISM

(71) Applicant: X-CEN-TEK GmbH & Co. KG, Wardenburg (DE)

(72) Inventors: Andreas Harms, Ofen (DE); Thomas Busch, Wardenburg (DE)

(73) Assignee: X-CEN-TEK GmbH & Co. KG, Wardenburg (DE)

( * ) Notice: Subject to any disclaimer, the term of this patent is extended or adjusted under 35 U.S.C. 154(b) by 0 days.

(21) Appl. No.: 15/974,791

(22) Filed: May 9, 2018

(65) Prior Publication Data

US 2018/0327139 A1 Nov. 15, 2018

(30) Foreign Application Priority Data

May 9, 2017 (DE) ..... 10 2017 110 016

(51) Int. Cl.

| | |
|---|---|
| ***B65D 21/08*** | (2006.01) |
| ***A45C 7/00*** | (2006.01) |
| ***A47G 9/08*** | (2006.01) |
| ***A45C 13/10*** | (2006.01) |
| *B65D 33/28* | (2006.01) |

(52) U.S. Cl.

CPC ..... *B65D 21/086* (2013.01); *A45C 7/0063* (2013.01); *A45C 13/1046* (2013.01); *A47G 9/086* (2013.01); *B65D 33/28* (2013.01)

(58) Field of Classification Search

CPC . B65D 21/086; A45C 7/0063; A45C 13/1046; A47G 9/086

USPC ..... 383/2

See application file for complete search history.

(56) References Cited

U.S. PATENT DOCUMENTS

| | | | | |
|---|---|---|---|---|
| 2,133,717 | A * | 10/1938 | Robes, Jr. | A47G 9/086 2/69.5 |
| 4,661,989 | A * | 4/1987 | Risby | A47G 9/086 383/120 |
| 2001/0031104 | A1* | 10/2001 | Vazquez | A45C 7/0063 383/2 |
| 2006/0137950 | A1* | 6/2006 | Nassanian | A45C 7/0063 190/119 |

FOREIGN PATENT DOCUMENTS

| | | | | |
|---|---|---|---|---|
| EP | 1600085 | A1 * | 11/2005 | A47G 9/086 |
| FR | 2754984 | A1 * | 4/1998 | A43C 7/08 |

OTHER PUBLICATIONS

Machine translation of FR-2754984-A1.*

* cited by examiner

*Primary Examiner* — Jes F Pascua

(74) *Attorney, Agent, or Firm* — Renner, Otto, Boisselle & Sklar, LLP

(57) ABSTRACT

A container with a taper mechanism, wherein the container is designed to be flexible and is provided for enclosing an object in the interior thereof, wherein the taper mechanism can pull together at least two pulling sides of a tapering surface of the container by means of at least one wire pull to reduce the circumference of the interior of the container, wherein the wire of the wire pull is alternately guided in spaced-apart wire pull guides arranged on the opposite pull sides along the pulling sides.

8 Claims, 3 Drawing Sheets

CONTAINER WITH A TAPER MECHANISM

RELATED APPLICATION DATA

This application claims priority of German Patent Application No. DE 10 2017 110 016.4 filed on May 9, 2017, which is hereby incorporated herein by reference.

FIELD OF THE INVENTION

The invention relates to a container with a taper mechanism, wherein the container is designed to be flexible and is provided for enclosing an object in the interior thereof.

BACKGROUND

Flexible containers such as sacks or similar structures are much easier to transport or store when they are snug against the object being transported.

In the prior art, we often work with externally folded sraps or similar, which is not only cumbersome and often uncomfortable, for example, when transporting a person, but is also insufficient using overhanging bays of the flexible material.

SUMMARY

The invention provides an improved container for enclosing an object, using, whereby adjustment to the object to enclosed is made possible.

More particularly, the invention relates to a container with a taper mechanism, wherein the container is designed to be flexible and is provided for enclosing an object in the interior thereof, wherein the taper mechanism can pull together at least two pulling sides of a tapering surface of the container by means of at least one wire pull to reduce the circumference of the interior of the container, wherein the wire of the wire pull is alternately guided in spaced-apart wire pull guides, arranged on the opposite pull sides, along the pulling sides.

As a result, an adaptation to the object to be transported is made possible in a particularly effective manner, by adaptation of the entire envelope, which is formed by the container.

Advantageously, the wire pull is arranged in a zigzag shape, wherein the tips are formed in the wire pulling guides. As a result, the pulling can be done very effectively.

Preferably, the wire pulling guides are formed by a plurality of eyelets or loops which are arranged on the pulling sides.

Advantageously, and therefore preferably, two zigzag-shaped wire pulls are arranged opposite each other between the pulling sides, the tips facing each other at the pulling sides.

Advantageously, said at least one wire is arranged between the tapering surface and a flexible cover surface provided therefor. This results in a closed surface to the outside and a recovery of the container with it enclosed object is simplified.

The top surface is advantageous at least partially connected along said at least one wire between the pulling sides with the tapering surface.

The following may be provided according to an embodiment of the invention that in the region of the wire pull guides the top surface and/or the taper surface has openings for easier threading of the wire pull(s).

Advantageously, the connections of the top surface with the tapering surface between the wire pulls are diamond-shaped. This corresponds to the course of the wire pulls and forms for them channels between the top surface and the tapering surface.

Preferably, it is provided according to an embodiment of the invention that at least one pocket is arranged for receiving the wire pull ends in or on the container.

Advantageously, the container has an opening which can be closed by means of a lid.

According to a variant of the invention it is provided that the taper mechanism is designed in the region of the lid.

Preferably, the container is a personal rescue bag.

Further advantageous embodiments will become apparent from the other dependent claims or their possible sub-combinations.

BRIEF DESCRIPTION OF THE DRAWINGS

The invention will be depicted below using the drawings. In detail, the diagrammatical illustrations are as follows.

The same reference numerals in the figures designate the same or equivalent elements.

DETAILED DESCRIPTION

Figure 1:
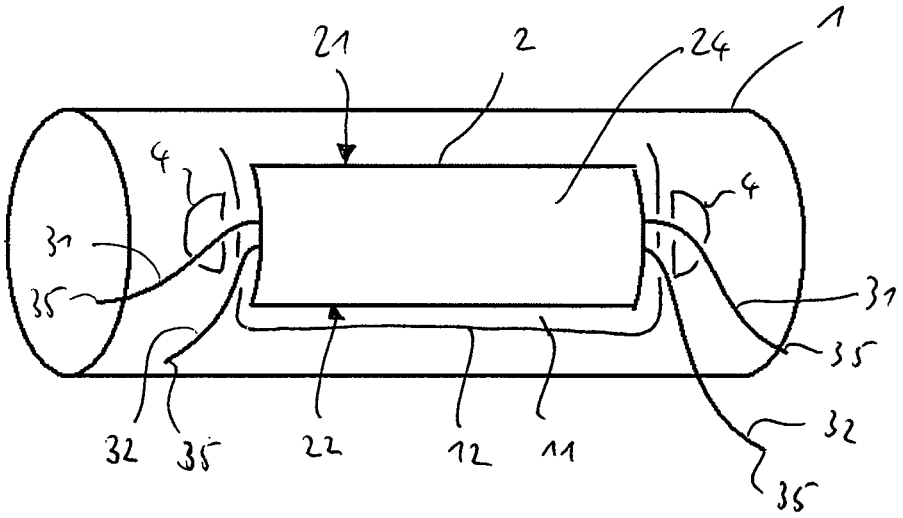
FIG. 1 is a schematic representation of a container according to the invention with a deactivated taper mechanism.

FIG. 1 shows an inventive container 1 for enclosing an object in the interior thereof with a taper mechanism 2 in the form of a personal rescue bag.

The container 1 is formed from a flexible material in the example shown.

Pockets 4 are arranged to receive the wire pull ends 35 on the container.

The container 1 has an opening 12 which is closable by means of a lid 11. The taper mechanism 2 is configured in the region of the lid 11.

Figure 2:
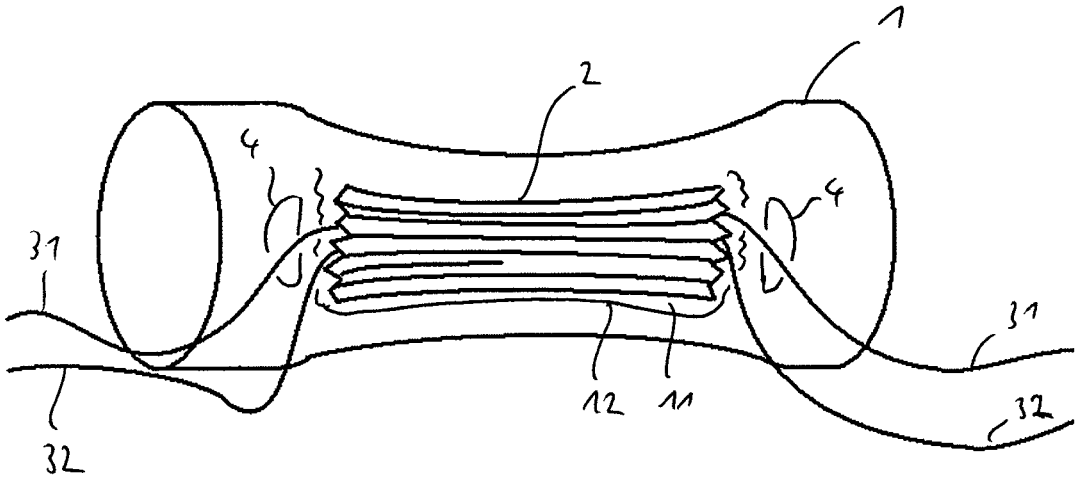
FIG. 2 is a schematic representation of the container of FIG. 1 with pulled taper mechanism.
Figure 3:
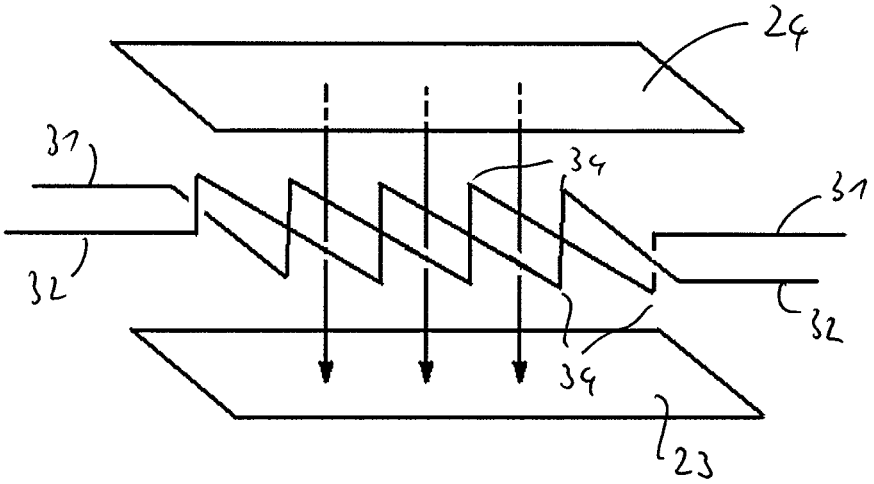
FIG. 3 is a schematic representation of the structure of the taper mechanism in layers.
Figure 4:
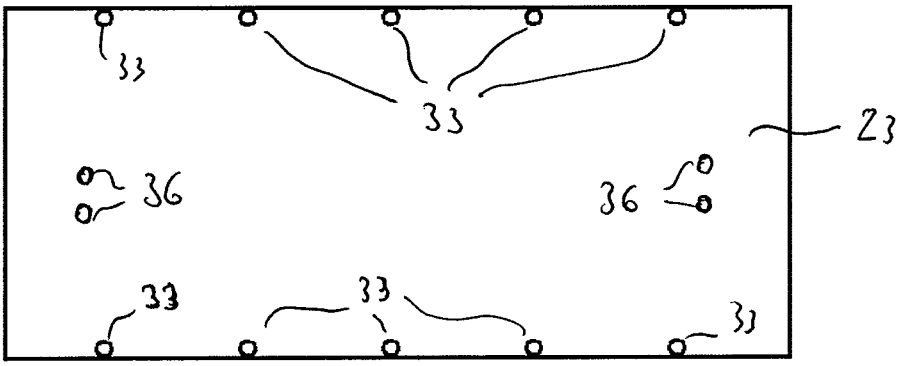
FIG. 4 is a schematic representation of the tapering surface with wire pull guides.
Figure 5:
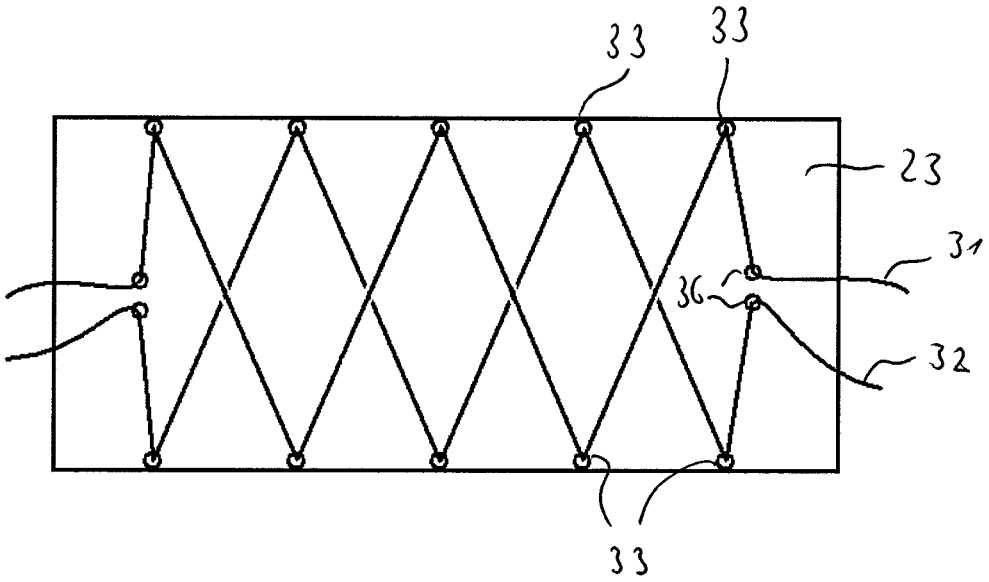
FIG. 5 is a schematic representation of the tapering surface in the wire pulls threaded in the wire pull guides.
Figure 6:
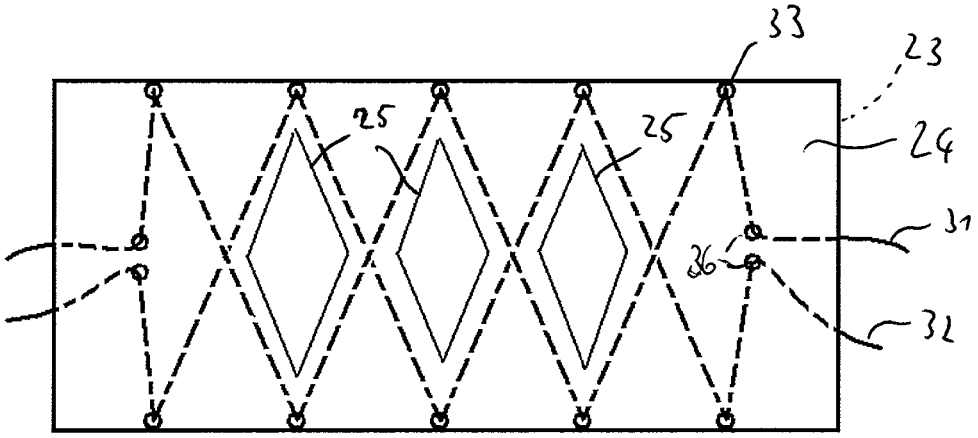
FIG. 6 is a schematic representation of the tapering surface with a top surface sewn thereon.

FIG. 2 is a schematic representation of the container 1 with pulled taper mechanism 2.

FIGS. 3 to 6 are schematic representations of the structure of the taper mechanism, shown in layers, from which the structure is more apparent.

In the example shown, the taper mechanism 2 consists of two pulling sides 21, 22 of a tapering surface 23 of the container 1. In this case, the container 1 can be pulled together at its pulling sides 21, 22, by means of two wire pulls 31 and 32 arranged symmetrically oppositely to reduce the circumference of the interior thereof.

The wires of the wire pulls 31, 32 are each guided alternately in the opposite pulling sides 21, 22, using wire pull guides 33 arranged along the pulling sides 21, 22 and spaced-apart. Preferably, the wire pull guides are formed by a plurality of eyelets or loops which are arranged on the pulling sides.

The two wire pulls 31 and 32 are arranged in a zigzag shape, wherein the tips 34 are formed in the wire pull guides 33. The tips 34 are located on the pulling sides 21, 22 opposite.

For improved entry into the wire guides, the wire pulls 31 and 32 are threaded into guiding ducts 36 at the beginning.

The wire pulls 31, 32 are arranged between the tapering surface 23 and a flexible top surface 24 provided for this purpose. The top surface 24 is partially connected along the wire pulls 31, 32 between the pulling sides 21, 22 with the tapering surface 23.

The connections of the top surface 24 with the tapering surface 23 between the wire pulls 31, 32 are configured by rhombic-shaped seams 25.

LIST OF REFERENCE SIGNS

1 Container
11 Lid
12 Opening
2 Taper mechanism
21,22 Pulling side
23 Tapering surface
24 Top surface
25 Seam
31,32 Wire pull
33 Wire pull guide
34 Tip
35 Wire pull end
36 Guiding duct
4 Pocket

What is claimed is:

1. A container with a taper mechanism, wherein the container is flexible and has an interior in which an object can be enclosed, wherein the taper mechanism includes at least one pull that can pull together at least two pulling sides of a tapering surface of the container to reduce the circumference of the interior of the container, wherein the pull is alternately guided in the at least two pulling sides via pull guides that are spaced-apart along the respective pulling sides, wherein the pull is arranged between the tapering surface and a flexible top surface, and wherein the flexible top surface is at least partially connected with the tapered surface along the pull by rhombic shaped connections between the at least two pulling sides.

2. The container with a taper mechanism according to claim 1, wherein the pull is arranged in a zigzag shape, and wherein tips are formed in the pull guides.

3. The container with a taper mechanism according to claim 1, wherein the pull guides are formed by a plurality of eyelets or loops which are arranged on the at least two pulling sides.

4. The container with a taper mechanism according to claim 3, wherein two zigzag-shaped pulls are arranged opposite to one another between the at least two pulling sides, and wherein tips are opposite to one another on the at least two pulling sides.

5. The container with a taper mechanism according to claim 1, wherein at least one pocket is arranged to receive ends of the pull in or on the container.

6. The container with a taper mechanism according to claim 1, wherein the container has an opening which is closable by way of a lid.

7. The container with a taper mechanism according to claim 6, wherein the taper mechanism is in the region of the lid.

8. The container with a taper mechanism according to claim 1, wherein the container is a personal rescue bag.

* * * * *